US010307627B2

(12) United States Patent
Blunk et al.

(10) Patent No.: US 10,307,627 B2
(45) **Date of Patent: *Jun. 4, 2019**

(54) CARBOSILANE CONTAINING FIRE-EXTINGUISHING FOAM

(71) Applicant: UNIVERSITÄT ZU KÖLN, Köln (DE)

(72) Inventors: Dirk Blunk, Hürth (DE); Ralf Helmut Hetzer, Wietzendorf (DE); Richard Daniel Matthias Meisenheimer, Köln (DE); Kai Oliver Wirz, Köln (DE)

(73) Assignee: UNIVERSITÄT ZU KÖLN, Cologne (DE)

( * ) Notice: Subject to any disclaimer, the term of this patent is extended or adjusted under 35 U.S.C. 154(b) by 362 days.

This patent is subject to a terminal disclaimer.

(21) Appl. No.: 14/772,378

(22) PCT Filed: Mar. 5, 2014

(86) PCT No.: PCT/EP2014/054287

§ 371 (c)(1),
(2) Date: Sep. 2, 2015

(87) PCT Pub. No.: WO2014/135601

PCT Pub. Date: Sep. 12, 2014

(65) Prior Publication Data

US 2016/0001115 A1 Jan. 7, 2016

(30) Foreign Application Priority Data

Mar. 6, 2013 (DE) ..... 10 2013 102 239

(51) Int. Cl.
*A62D 1/02* (2006.01)
*A62D 1/00* (2006.01)

(52) U.S. Cl.
CPC ..... *A62D 1/0071* (2013.01); *A62D 1/00* (2013.01); *A62D 1/0035* (2013.01)

(58) Field of Classification Search
None
See application file for complete search history.

(56) References Cited

U.S. PATENT DOCUMENTS

| | | | | |
|---|---|---|---|---|
| 5,430,166 | A | 7/1995 | Klein et al. | |
| 5,831,080 | A * | 11/1998 | Sejpka | C07H 15/04 536/120 |
| 9,446,272 | B2 * | 9/2016 | Blunk | A62D 1/0071 |
| 9,687,686 | B2 * | 6/2017 | Blunk | A62D 1/0071 |
| 2007/0134283 | A1 | 6/2007 | Wang et al. | |
| 2007/0135329 | A1 | 6/2007 | Wang et al. | |
| 2009/0259062 | A1 * | 10/2009 | Wang | B01F 17/0071 556/431 |

FOREIGN PATENT DOCUMENTS

| | | | |
|---|---|---|---|
| DE | 4306041 | A1 | 9/1994 |
| DE | 4441391 | A1 | 5/1996 |
| DE | 102007016966 | A1 | 10/2008 |
| DE | 102011053304 | A1 | 3/2013 |
| EP | 0710500 | B1 | 5/1996 |
| JP | 2002-119840 | | 4/2002 |
| JP | 2006-316590 | | 11/2006 |
| SU | 262394 | A1 | 1/1970 |

OTHER PUBLICATIONS

Wagner et al. ("Silicon-Modified Carbohydrate Surfactants I: Synthesis of Siloxanyl Moieties Containing Straight-Chained Glycosides and Amides" Applied Organometallic Chemistry, vol. 10, 1996, 421-435) (Year: 1996).*

Han et al., New family of Gemini surfactants with glucosamide-based trisiloxane, journal, Colloids and Surfaces A: Physicochem. Eng.Aspects 237 (2004), pp. 79-85, Elsevier.

* cited by examiner

*Primary Examiner* — Joseph D Anthony
(74) *Attorney, Agent, or Firm* — Patent Technologies, LLC; Robert D. Gunderman, Jr.

(57) ABSTRACT

The invention relates to fire-extinguishing foams or concentrates, which include a carbohydrate containing silane surfactant.

4 Claims, No Drawings

CARBOSILANE CONTAINING FIRE-EXTINGUISHING FOAM

The present invention relates to the field of fire-extinguishing foams or foam concentrates.

Particularly in fires of larger liquid amounts of organic chemicals such as fuels usually special foam concentrates are added to the extinguishing water. These have surfactant properties and in contrast to conventional fire-extinguishing foams enable the independent wetting of the surface of the burning material. Therefore, such so-called AFFF (Aqueous Film Forming Foams) extinguishing foams as a specific feature form a water film on the surface of the burning liquid. The thus resulting vapor barrier makes it difficult that the flammable liquid transits into the gas phase and thus maintains the fire or forms gas mixtures capable of ignition or explosion. The characteristic wettability of the AFFF foams also allows the foam to slide on the surface of the burning liquid, such that even positions are attained onto which the extinguishing foam cannot be applied directly. In addition, the foam surface closes self-dependently after disturbance (e.g. by falling objects). Furthermore, the film even flows and acts in areas which are not attained directly by foam.

For a long time perfluorooctyl sulfonate (PFOS) was assumed as a means of choice in such fire-extinguishing foams. However, since it has been recognized as toxic, persistent and bioaccumulative, its use has been strongly restricted by the EU directive 2006/122/EC of 12 Dec. 2006. Extinguishing foams containing more than 50 ppm PFOS may no longer be used in the EU. Today in AFFF various other perfluorinated or polyfluorinated surfactants are used as substitutes for PFOS. With respect to these surfactants it is hitherto believed that they are not, or at least less bioaccumulative and toxic. A final assessment in this regard is still pending and the fundamental problem of the persistence of polyfluorinated compounds is retained in any case.

Thus, it is an object to find alternative efficient AFFF fire-extinguishing foam concentrates containing surfactants which are equally effective as much as possible but preferably less toxic and preferably halogen-free.

This object is achieved by claim 1 of the present invention. Accordingly, a fire-extinguishing foam concentrate is proposed, which comprises a surfactant containing at least one substituted or unsubstituted carbohydrate or carbohydrate derivative and at least one oligosilane.

The term "comprising" in this context means that both the carbohydrate and the carbohydrate derivative as well as the oligosilane are subcomponents of a larger molecule and both are linked to the rest of the molecule via covalent bonds.

It has surprisingly been found that such surfactants are suitable for the production of aqueous film-forming fire-extinguishing foams and depending on the application at least one of the following advantages can be achieved:

- due to the high water solubility of the carbohydrates the total molecular size of the surfactants according to the invention is sufficiently small with adequate solubility; small molecules are preferred for most applications because their diffusion coefficients are higher.
- the surfactant is halogen-free, in particular fluorine-free and can essentially be produced from renewable raw materials,
- the surfactants allow the self-dependent formation of a closed water film on the surface of a burning material (e.g. fuel): as a vapor barrier this water film impedes the transition of the flammable liquid into the gas phase and in this way minimizes that the burning material maintains the fire and/or forms gas mixtures capable of burning or explosion.
- due to the water film formation it is particularly suitable for liquid fires without containing poly- or perfluorinated compounds;
- the surfactants have an excellent durability, in particular hydrolytic stability.

According to a preferred embodiment of the invention the surfactant comprises a molecule selected from the group consisting of

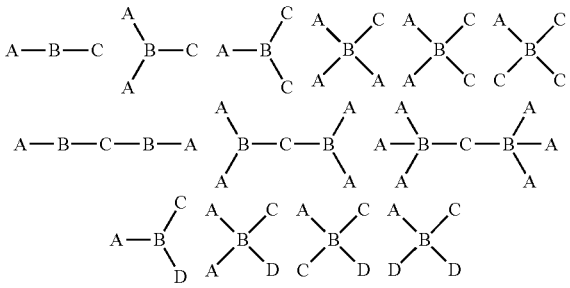

or mixtures thereof, wherein

A is a substituted or unsubstituted carbohydrate or carbohydrate derivative including one to twenty, preferably one to four sugar units, B represents an optional linker substructure of at least one atom or a chain, C is an oligosilane, preferably a di-, tri-, tetra- or pentasilane, and D is an oligosiloxane, preferably a di-, tri- or tetrasiloxane, In the following the subcomponents of the surfactant are explained in detail, wherein individual characteristics or information can be combined arbitrarily.

Subcomponent A:

A is a substituted or unsubstituted carbohydrate or carbohydrate derivative including one to twenty, preferably one to four sugar units. Preferably on the one side are mono-, di- and trisaccharides, i.e. one, two or three sugar units, alternatively and preferred as well are higher saccharides, in particular cyclodextrins.

Furthermore, the subcomponent A or parts of the subcomponent. A can also consist of carbohydrate derivatives such as the sugar acids (aldonic acids, uronic acids or aldaric acids), sugar alcohols (alditols), amino sugars or cyclitols, and their ethers, esters, amides or thioesters.

The term "sugar unit" or "carbohydrate" in particular refers to hexoses, pentoses or cyclitols, which are preferably bonded glycosidically to one another (in the presence of di- or higher saccharides).

Other regiochemical links of the sugar units to one another or of the substituents (linkers) to them, however, are not explicitly excluded.

As described, the carbohydrates can be substituted or unsubstituted, wherein unsubstituted carbohydrates are preferred because of the resultant higher water solubility.

Inasmuch as the carbohydrates are substituted, etylenoxy, oligo(ethylenoxy), methyl, ethyl, propyl, allyl or acetyl substituents are preferred.

Preferred carbohydrates or carbohydrate derivatives in the sense of the present invention are with respect to monosaccharides: glucose, glucosamine, fructose, galactose:

with respect to disaccharides: maltose, isomaltose, sucrose, cellobiose, lactose, trehalose;

with respect to trisaccharides: raffinose, maltotriose, isomaltotriose, maltotriulose, ciceritol;

with respect to cyclitols: inositols, quebrachitol, pinitol;

with respect to sugar acids: gluconic acid, glucuronic acid, glucaric acid, tartaric acid, galactonic acid, galacturonic acid, galactaric acid, mannonic acid, mannuronic acid, mannaric acid, fructonic acid, fructuronic acid, fructaric acid, arabinonic acid, arabinuronic acid, arabinaric acid, xylonic acid, xyluronic acid, xylaric acid, ribonic acid, riburonic acid, ribaric acid, ascorbic acid:

with respect to alditols: sorbitol, xylitol, mannitol, lactitol, maltitol, isomaltitol, threitol, erythritol;

with respect to higher saccharides: α-cyclodextrin, β-cyclodextrin, γ-cyclodextrin, δ-cyclodextrin.

Subcomponent B:

B is an optional linker substructure of at least one atom or a chain, preferably of carbon and/or nitrogen and/or oxygen atoms (wherein O—O bonds should be excluded).

This chain can be a pure alkyl chain, i.e. B is an unsubstituted or optionally alkyl-substituted alkylene residue, preferably with three, four, five, six or seven carbon atoms. Particularly preferred are propylene bridges (i.e. three carbon atoms).

Alternatively B can include ether, ester, amide or amine groups. For example, B can contain glycerin, pentaetythrit, alkyl amines or carboxylic acids as a substructure.

Still alternatively and inasmuch preferred B contains an oligoethylene or oligopropylene glycol unit, preferably including two three or four units. As a bond to the residue C preferably an ethylene or propylene unit is used.

B is preferably linked glycosidically to the residue A via an anomeric carbon atom. In the case of a carboxylic acid derivative as A B can also be linked to A via an amide or ester bond.

B is linked to the residue C (the silane) via a Si—C, Si—O or Si—N bond.

It should be noted that with some surfactants according to the present invention subcomponent B may be omitted, i.e. A and C are optionally directly linked to each other.

Furthermore, in some surfactants according to the present invention the residue B—C or C can also be bonded to other regiochemical positions of the carbohydrate or carbohydrate derivative A.

Subcomponent C:

C is a oligosilane, preferably a di-, tri-, tetra or pentasilane, wherein C should explicitly not be restricted thereto and also larger residues should be included. "Oligosilane" in the sense of the present invention means compounds or residues/"partial compounds", which either include more than one $SiR^1R^2R^2R^4$-unit ($R^1$, $R^2$, $R^3$, $R^4$=identical or different organic residues, such that there are four Si—C bonds); or includes a $SiR^1R^2R^3R^4$-unit ($R^1$, $R^2$, $R^3$, $R^4$=identical or different organic residues, such that there are four Si—C bonds) and at least one further siloxane unit (i.e., a compound $SiR^1R^2R^3R^4$, wherein at least one of the R's is an alkoxy or oxo residue). It should be noted that these compounds are usually referred to as oxacarbosilanes. In the sense of the present invention, however, for the sake of better readability and clarity, these compounds for simplicity are also referred to as oligosilanes or these compounds are also sorted into the group of oligosilanes.

Herein, "terminal" tri(m)ethylsilanes are preferred (i.e, they include three methyl and/or ethyl units or two methyl and one ethyl or two ethyl and one methylene unit(s)).

The individual silanes are preferably bonded via methylene, ethylene or propylene bridges, particularly preferably methylene units, because they do not reduce the amphiphobicity of the entire molecule too much. In the case that C also includes siloxane units of course Si—O—Si bridges are present.

If C is a tri- or a higher silane, C may be linked to B (or possibly A) via one of the terminal silanes (such that a kind of "continuous chain" is formed), alternatively. C can also be linked to B for optionally A) via one of the middle position silanes such that a kind of X-shaped or T-shaped or branched structure is formed.

Optionally the substructures A-B or A bonded to C may be of the same type or different.

Preferably C has one of the following structures:

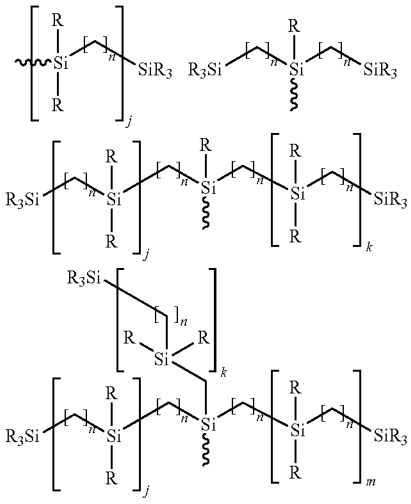

wherein each R is independently ethyl or methyl, n (each independently) represents 1, 2 or 3, and j, k, m is 1-9, preferably 1, 2 or 3, wherein $1 \leq j+k+m \leq 10$.

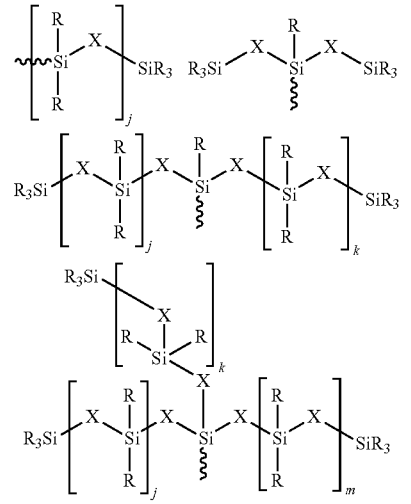

wherein each R is independently ethyl or methyl, each X is independently $(CH_2)_n$ or O, wherein n (each independently) represents 1, 2 or 3, and j, k, m is 1-9, preferably 1, 2 or 3, wherein $1 \leq j+k+m \leq 10$; and

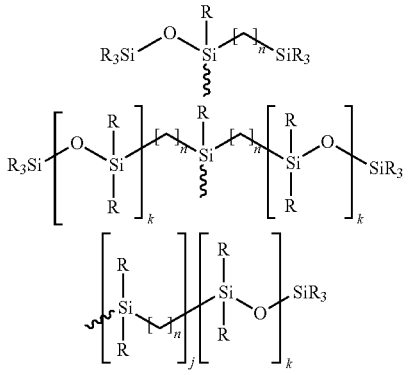

wherein each R is independently ethyl or methyl, each X is independently $(CH_2)_n$ or O, wherein n (each independently) represents 1, 2 or 3, and j, k is 1-9, preferably 1, 2 or 3, wherein $1 \leq j+k \leq 10$.

If C is "in a middle position" of course one of the residues R is changed accordingly.

Subcomponent D:

D is an oligosiloxane, preferably a di-, tri- or tetrasiloxane. Herein the methyl and ethyl siloxanes or mixed siloxanes with methyl and ethyl residues are preferred.

If C is a tri- or higher siloxane D can be linked to B (or optionally A) via one of the terminal siloxanes (such that a kind of "continuous chain" is formed), alternatively, D can be linked to B (or optionally A) via one of the middle position siloxanes, such that a kind of X-shaped or T-shaped or branched structure is formed. If D is derived from a di- or tri-hydrosiloxan, the substructures A-B or A boned to D may be of the same type or different.

Preferably, D has one of the following structures:

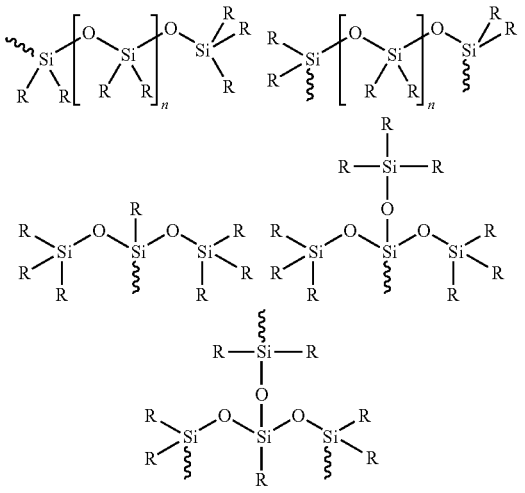

wherein each R is independently ethyl or methyl and n is the range between 0 and 10, preferably between 0 and 5, and is more preferably 0, 1 or 2.

According to a preferred embodiment of the present invention the fire-extinguishing foam concentrate additionally comprises one or more of the following components:

Foaming agents, film formers, film stabilizers, antifreeze agents, preservative and anti-corrosion agents, solubilizers and buffers.

In the following these components are explained in more detail, wherein individual characteristics or information can be combined arbitrarily.

Foaming Agents:

In order to improve the foaming co-surfactants can be added. In particular, these can be: linear alkyl benzene sulfonates, secondary alkane sulfonates, sodium alkyl sulfonates, α-olefin sulfonates, sulfosuccinic acid esters, α-methyl ester sulfonates, alcohol ethoxylates, alkyl phenol ethoxylates, fatty alcohol ethylene oxide/propylene oxide adducts, glycoside surfactants (these are particularly preferred, for example glucopon) lauryl sulfates, laureth sulfate, imidazolium salts, lauriminodi propionat, acrylic copolymers. As counterions for the anionic surfactants contained in this list mainly $Li^+$, $Na^+$, $K^+$, $NH_4^+$, $N(C_2H_5)_4^+$ come into consideration.

Film-Forming Agents, Film Stabilizers:

In order to improve the foam properties the following components, among others, can be added to the foam concentrate: polysaccharides, alginates, xanthan gum, starch derivatives.

Antifreezes:

In order to improve the frost resistance and the application ability at low temperatures, the following components, among others, may be added to the foam concentrate: ethylene glycol, propylene glycol glycerin, 1-propanol, 2-propanol, urea, inorganic salts.

Preservatives and Anti-Corrosion Agents:

In order to improve the storage stability and to protect the storage vessels and -apparatuses the following components, among others, can be added to the foam concentrate: formaldehyde solution, alkylcarboxylic acid, ascorbic acid, salicylic acid, tolyltriazoles.

Solubilizers:

In order to improve the solubility of the components the following components, among others, can be added to the foam concentrate butyl glycol, butyl diglycol, hexylene glycol.

Buffers:

Glycosides and siloxane surfactants are pH-sensitive in terms of storage. Thus, buffering the concentrate to a pH value of about 7 is advantageous. Buffer systems may be, for example:

potassium dihydrogen orthophosphate/sodium hydroxide, tris(hydroxymethyl)aminomethane/hydrochloric acid, disodium hydrogenphosphate/citric acid/sodium hydroxide, Citric acid/sodium acetate.

The present invention also relates to the use of a surfactant including at least one substituted or unsubstituted carbohydrate or carbohydrate derivative and at least one oligosilane as an additive for fire-extinguishing foams and/or concentrates.

The components to be used according to the invention mentioned above and claimed and described in the exemplary embodiments are not subject to particular exceptional conditions with respect, to their size, shape, material selection and technical conception, so that the selection criteria known in the area of application can be applied without restriction.

Further details, features and advantages of the subject matter of the invention result from the dependent claims and the following description of the corresponding examples, which are to be understood as merely illustrative and not restrictive.

EXAMPLE I

Example I refers to a surfactant according to the present invention having the following structure:

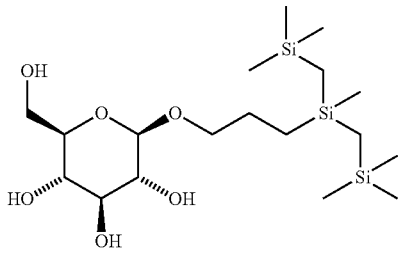

The spreading behavior of solutions of various concentrations of Example I with 6.0 g/l and 12 g/l Gluopon 215 CSUP (alkylpolyglycoside) was examined. The results are summarized in the following table:

TABLE I

| Example I g/l | Glucopon g/l | Spreading behaviour |
|---|---|---|
| 5.0 | 12.0 | Spreads moderately |
| 4.0 | 12.0 | Spreads middle rate |
| 3.0 | 12.0 | Spreads slowly |
| 2.0 | 12.0 | Spreads slowly |
| 3.0 | 6.0 | Spreads moderately |
| 2.0 | 6.0 | Spreads middle rate |
| 1.0 | 6.0 | Spreads slowly |
| 0.5 | 6.0 | Spreads very slowly |

EXAMPLE II

Example II relates to a surfactant according to the present invention having the following structure:

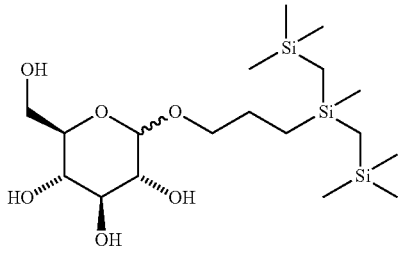

The spreading behavior of a solution of 2.0 g/l of Example II and 6.0 g/l Glucopon 215 CSUP (alkylpolyglycoside) was examined; it has been found that this compound spreads very slowly.

EXAMPLE III

Example III relates to a surfactant according to the present invention having the following structure

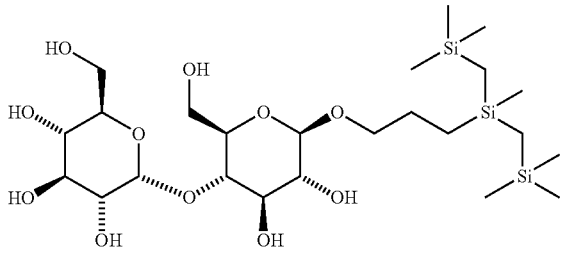

The spreading behavior of solution of 2.0 g/l of Example III and 6.0 g/l Glucopon 215 CSUP (alkylpolyglycoside) was examined; it has been found that this compound spreads very slowly.

EXAMPLE VI

Example IV relates to a surfactant according to the present invention having the following structure

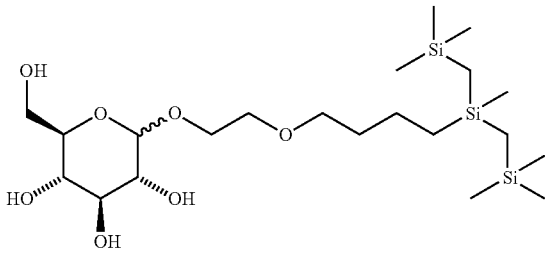

The spreading behavior of a solution of 2.0 g/l of Example IV and 6.0 g/l Glucopon 215 CSUP (alkylpolyglycoside) was examined; it has been found that this compound spreads slowly.

EXAMPLE V

Example V relates to a surfactant according to the present invention having the following structure.

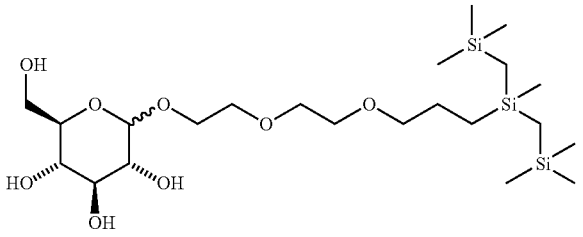

The spreading behavior of a solution of 2.0 g/l of Example V and 6.0 g/l Glucopon 215 CSUP (alkylpolyglycoside) was examined; it has been found that this compound spreads slowly.

EXAMPLE VI

Example VI relates to mixture of two surfactants, one of them according to the present invention having the following structures:

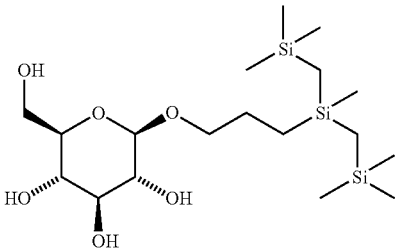

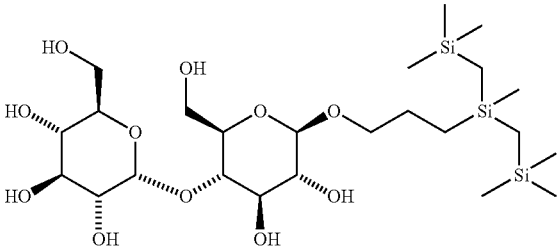

The spreading behavior of a solution of each 0.5 g/l and 1.0 g/l of the individual components of Example VI and 6.0 g/l Glucopon 215 CSUP (alkylpolyglycoside) was examined; it has been found that these mixtures spread fast and very fast, respectively.

EXAMPLE VII

Example VII relates to surfactant according to the present invention having the following structure:

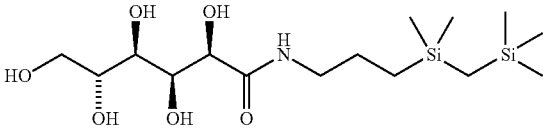

The spreading behavior of a solution of 4.0 g/l of Example VII and 6.0 g/l Glucopon 215 CSUP (alkylpolyglycoside) was examined; it has been found that this compound spreads very slowly.

EXAMPLE VIII

Example VIII relates to a surfactant according to the present invention having the following structure:

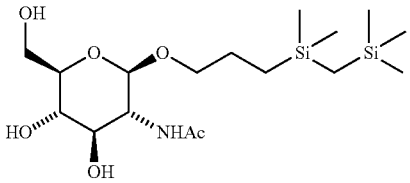

The spreading behavior of a solution of 4.0 g/l of Example VIII and 6.0 g/l Glucopon 215 CSUP (alkylpolyglycoside) was examined; it has been found that this compound spreads very slowly and on a small area.

Manufacture of Glycosidsilane

The silane glycoside surfactants shown in the examples can, inter alia, be prepared from the corresponding carbohydrates as follows:

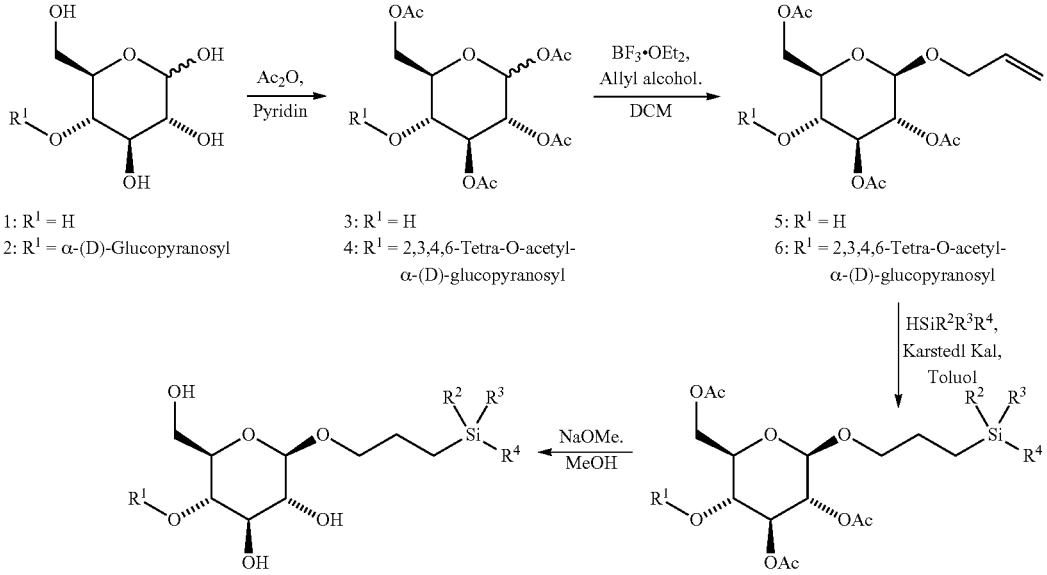

1: $R^1$ = H
2: $R^1$ = α-(D)-Glucopyranosyl

3: $R^1$ = H
4: $R^1$ = 2,3,4,6-Tetra-O-acetyl-α-(D)-glucopyranosyl

5: $R^1$ = H
6: $R^1$ = 2,3,4,6-Tetra-O-acetyl-α-(D)-glucopyranosyl

7: $R^1$ = H, $R^2$ = $R^3$ = $CH_2SiMe_3$, $R^4$ = Me
8: $R^1$ = H, $R^2$ = $R^3$ = $R^4$ = $CH_2SiMe_3$
9: $R^1$ = 2,3,4,6-Tetra-O-acetyl-α-(D)-glucopyranosyl, $R^2$ = $R^3$ = $CH_2SiMe_3$, $R^4$ = Me
10: $R^3$ = 2,3,4,6-Tetra-O-acetyl-α-(D)-glucopyranosyl, $R^2$ = $R^3$ = $R^4$ = $CH_2SiMe_3$ 11: $R^1$ = H, $R^2$ = $R^3$ = $CH_2SiMe_3$, $R^4$ = Me
12: $R^1$ = H, $R^2$ = $R^3$ = $R^4$ = $CH_2SiMe_3$
13: $R^1$ = α-(D)-Glucopyranosyl, $R^2$ = $R^3$ = $CH_2SiMe_3$, $R^4$ = Me
14: $R^1$ = α-(D)-Glucopyranosyl, $R^2$ = $R^3$ = $R^4$ = $CH_2SiMe_3$ Example VII has been prepared as follows:

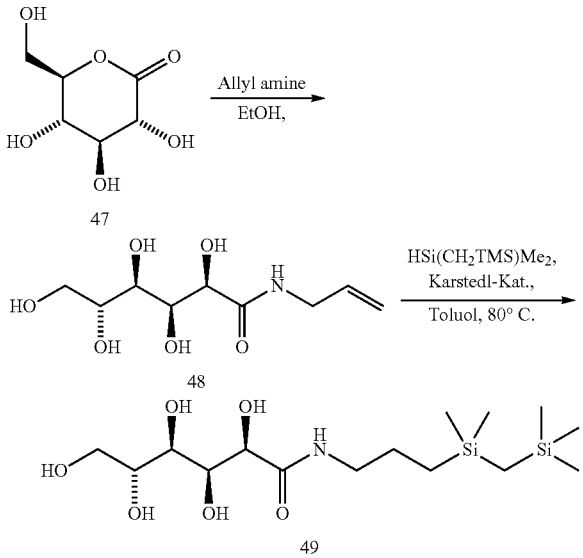

Investigation of the Spreading Behavior

In order to investigate the spreading behavior 5 ml cyclohexane were placed in a Petri dish 9 cm in diameter. Then one drop of an unfoamed surfactant solution was respectively added and it was observed whether and how the surfactant solution spreads on the surface of the cyclohexane.

The individual combinations of the components and features of the embodiments mentioned above are exemplary; the replacement and substitution of these teachings with other teachings that are included in this document with the cited references are also explicitly contemplated. A person skilled in the art will recognize that in addition to the embodiments described herein variations, modifications and other embodiments may be realized without departing from the spirit and scope of the invention. Thus, the above description is to be considered as exemplary rather than limiting. The term "comprise" or "include" used in the claims does not exclude other elements or steps. The indefinite article "a" does not exclude the meaning of a plural.

The mere fact that certain measures are recited in mutually different claims does not imply that a combination of these measures cannot be used to advantage. The scope of the invention is defined in the following claims and their equivalents.

The invention claimed is:

1. A method of manufacturing a fire extinguishing foam comprising the steps of:

providing a concentrate comprising a surfactant containing at least one substituted or unsubstituted carbohydrate or carbohydrate derivative and at least one oligosilane, wherein the surfactant comprises a molecule that is selected from the group consisting of:

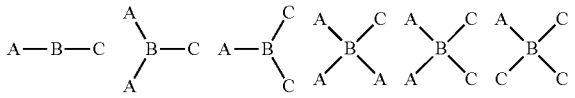

-continued

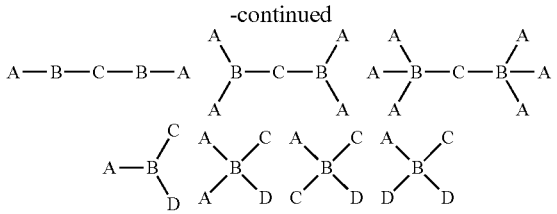

or mixtures thereof, wherein A is a substituted or unsubstituted carbohydrate or carbohydrate derivative comprising one to twenty sugar units, B represents a linker substructure of at least one atom or chain, C is an oligosilane or oxacarbosilane, and D is an oligosiloxane;

diluting the concentrate with water;

mixing the diluted concentrate to form a diluted mixture; and aerating the diluted mixture to form a fire extinguishing foam.

2. The method of manufacturing a fire extinguishing foam according to claim 1, wherein C is a di-, tri-, tetra- or pentasilane.

3. The method of manufacturing a fire extinguishing foam according to claim 1, wherein C is selected from one of the following structures:

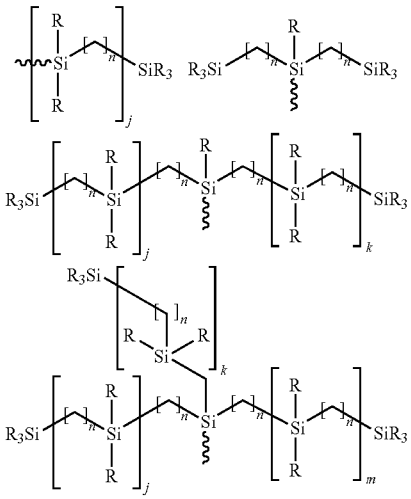

wherein each R is independently ethyl or methyl, n (each independently) represents 1, 2 or 3, and j, k, m is 1-9, wherein $1 \leq j+k+m \leq 10$;

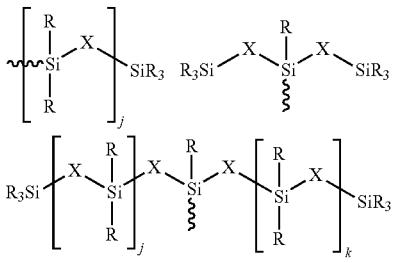

-continued

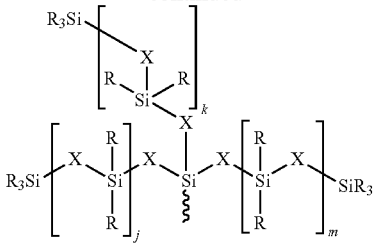

wherein each R is independently ethyl or methyl, each X is independently $(CH_2)_n$ or O, wherein n (each independently) is 1, 2 or 3, and j, k, m is 1-9, wherein $1 \leq j+k+m \leq 10$; and

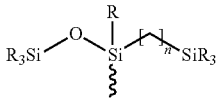

-continued

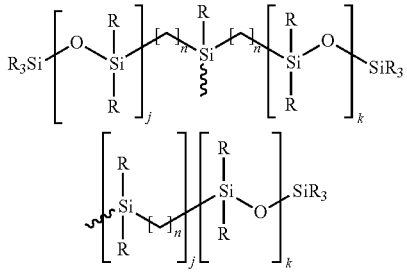

wherein each R is independently ethyl or methyl, each X is independently $(CH_2)_n$ or O, wherein n (each independently) is 1, 2 or 3, and j, k, m is 1-9 wherein $1 \leq j+k \leq 10$.

4. The method of manufacturing a fire extinguishing foam according to claim 1, wherein A represents a mono-, di- and trisaccharide, a sugar acid, an amino sugar or cyclitol, or an ether, ester, amide or thioester of these compounds.

* * * * *